US011152749B2

(12) United States Patent
Xu et al.

(10) Patent No.: US 11,152,749 B2
(45) Date of Patent: Oct. 19, 2021

(54) ELECTRICAL CONNECTOR WITH IMPROVED GROUNDING PERFORMANCE

(71) Applicant: DONGGUAN LEADER PRECISION INDUSTRY CO., LTD., Dongguan (CN)

(72) Inventors: Hongqiang Xu, Dongguan (CN); Lijun Xu, Dongguan (CN)

(73) Assignee: DONGGUAN LEADER PRECISION INDUSTRY CO., LTD., Dongguan (CN)

( * ) Notice: Subject to any disclaimer, the term of this patent is extended or adjusted under 35 U.S.C. 154(b) by 0 days.

(21) Appl. No.: 16/918,401

(22) Filed: Jul. 1, 2020

(65) Prior Publication Data

US 2021/0006015 A1 Jan. 7, 2021

(30) Foreign Application Priority Data

Jul. 3, 2019 (CN) ..... 201921025791.8
Jul. 3, 2019 (CN) ..... 201921026551.X

(51) Int. Cl.

| | |
|---|---|
| ***H01R 13/6581*** | (2011.01) |
| ***H01R 13/502*** | (2006.01) |
| ***H01R 13/6596*** | (2011.01) |
| ***H01R 24/60*** | (2011.01) |
| ***H01R 13/52*** | (2006.01) |

(52) U.S. Cl.

CPC ..... *H01R 13/6581* (2013.01); *H01R 13/502* (2013.01); *H01R 13/521* (2013.01); *H01R 13/6596* (2013.01); *H01R 24/60* (2013.01)

(58) Field of Classification Search

None

See application file for complete search history.

(56) References Cited

U.S. PATENT DOCUMENTS

| | | | | |
|---|---|---|---|---|
| 9,673,552 | B2 * | 6/2017 | Tsai | H01R 13/405 |
| 10,211,573 | B2 * | 2/2019 | Zhao | H01R 13/405 |
| 10,535,957 | B2 * | 1/2020 | Zhao | H01R 13/6585 |
| 10,978,831 | B2 * | 4/2021 | Zhao | H01R 13/6581 |
| 2017/0324188 | A1 * | 11/2017 | Guo | H01R 13/5202 |

(Continued)

FOREIGN PATENT DOCUMENTS

| | | |
|---|---|---|
| CN | 204538373 U | 8/2015 |
| CN | 206148728 U | 5/2017 |

(Continued)

*Primary Examiner* — Oscar C Jimenez

(74) *Attorney, Agent, or Firm* — Birch, Stewart, Kolasch & Birch, LLP

(57) ABSTRACT

The present application discloses an electrical connector including a first lower insulating housing, a second upper insulating housing, a number of first conductive terminals held on the first lower insulating housing, and a number of second conductive terminals held on the second upper insulating housing. Each first conductive terminal includes a first tail portion for connecting with a printed circuit board. Each second conductive terminal includes a second tail portion for connecting with the printed circuit board. The first tail portions are arranged in a first and front row and the second tail portions are arranged in a second and rear row spaced away from the first and front row. A waterproof plate is formed between the first tail portions and the second tail portions by glue injection.

18 Claims, 5 Drawing Sheets

(56) References Cited

U.S. PATENT DOCUMENTS

| | | | | |
|---|---|---|---|---|
| 2018/0151992 | A1* | 5/2018 | Zhao | H01R 13/6586 |
| 2018/0287291 | A1* | 10/2018 | Kifune | H01R 13/5219 |
| 2018/0337488 | A1* | 11/2018 | Zhang | H01R 12/716 |
| 2019/0067860 | A1* | 2/2019 | Zhao | H01R 13/405 |

FOREIGN PATENT DOCUMENTS

| | | | |
|---|---|---|---|
| CN | 207353557 | U | 5/2018 |
| TW | I566481 | B | 1/2017 |

* cited by examiner

ELECTRICAL CONNECTOR WITH IMPROVED GROUNDING PERFORMANCE

CROSS-REFERENCE TO RELATED APPLICATIONS

This patent application claims priorities of a Chinese Patent Application No. 201921026551.X, filed on Jul. 3, 2019 and titled "Electrical Connector", and a Chinese Patent Application No. 201921025791.8, filed on Jul. 3, 2019 and titled "Electrical Connector", the entire contents of which are incorporated herein by reference.

TECHNICAL FIELD

The present application relates to an electrical connector, in particular to an electrical connector having at least better waterproof or grounding effect.

BACKGROUND

A USB Type C electrical connector usually includes an insulating body, a plurality of conductive terminals retained in the insulating body, a metal shell shielding outside of the insulating body, and an insulative cover over-molding outside the metal shell.

The electrical connector cooperates with a mating connector for electrical signal transmission. The electrical connector is torn on the surface of the metal shell to form an elastic sheet, and the elastic sheet is used to abut against the mating connector for grounding. However, the position of the metal shell that is torn to form the elastic sheet will inevitably form a gap. When the electrical connector is positioned in a humid environment, water maybe easily enter into the electrical connector through the gap and affect the performance of the electrical connector. With the development of the electronics industry, waterproof performance is becoming more and more important to the electrical connector, which has attracted increasing attention of the industry. The common practice in the industry is usually to open a slot in the insulative cover through the mold core during the second injection molding process, and then glue is injected into the slot of the insulative cover to form a waterproof plate. Therefore, the molding process is additional, which affects production efficiency. Due to the slots formed in the insulative cover, although the waterproof plate is filled with glue, the material of the waterproof plate and the insulative cover is not consistent, which affects the appearance of the product.

The metal shell is usually an integrated inner metal shell which normally has a grounding function to achieve electromagnetic shielding effect. The integrated inner metal shell cannot technically realize the grounding function of the lower leg. Therefore, an outer metal shell is usually welded onto the integrated inner metal shell for grounding. In the USB Type C electrical connector, a metal shield sandwiched between the first upper insulating block and the second lower insulating block is connected to the ground line on the printed circuit board through a pair of legs. If the outer metal shell is connected to another ground line on the printed circuit board via another pair of legs, it requires a larger area for positioning the ground lines on the printed circuit board.

SUMMARY

The present application discloses an electrical connector which includes a first lower insulating housing, a second upper insulating housing, a plurality of first conductive terminals held on the first lower insulating housing, a plurality of second conductive terminals held on the second upper insulating housing and a waterproof plate. Each first conductive terminal includes a first tail portion for connecting with a printed circuit plate. The first tail portions are arranged in a first and front row. Each second conductive terminal includes a second tail portion for connecting with the printed circuit board. The second tail portions are arranged in a second and rear row which is spaced away from the first and front row of the first tail portions. The waterproof plate is formed between the first tail portions and the second tail portions by glue injection.

Besides, the present application discloses an electrical connector which includes an insulating body, a plurality of terminals retained in the insulating body, a shielding plate embedded in the insulating body, an inner metal shell enclosing the insulative body and an outer metal shell assembled to the inner metal shell. The shielding plate includes a base portion and at least one leg portion extending vertically from at least one lateral side of the base portion for electrically connecting with at least one grounding pad of a printed circuit board. The inner metal shell is connected to the outer metal shell which is further connected to the shielding plate so that grounding connection among the inner metal shell, the shielding plate and the outer metal shell is established.

Furthermore, the present application discloses an electrical connector which includes a first lower insulating housing, a second upper insulating housing, a plurality of first conductive terminals, a plurality of second conductive terminals, an insulating body, a shielding plate, an inner metal shell, an outer metal shell and a waterproof plate. The first conductive terminals are retained in the first lower insulating housing. The second conductive terminals are retained in the second upper insulating housing. The insulating body is molded over the first lower insulating housing and the second upper insulating housing. The shielding plate is sandwiched between the first lower insulating housing and the second upper insulating housing, and is embedded in the insulating body. The shielding plate includes a base portion and at least one leg portion extending vertically from at least one lateral side of the base portion for electrically connecting with at least one grounding pad of a printed circuit board. The inner metal shell encloses the insulative body. The outer metal shell is assembled to the inner metal shell to keep grounding connection between the inner metal shell and the shielding plate. The waterproof plate is formed by glue injection into a slot which is formed by stacking the first insulating housing and the second insulating housing.

Compared with the prior art, the present application realizes either better waterproof function or better grounding effect, improves the production efficiency, optimizes the appearance of the product, and also reduces the need for a ground area on a printed circuit board.

DETAILED DESCRIPTION

Figure 1:
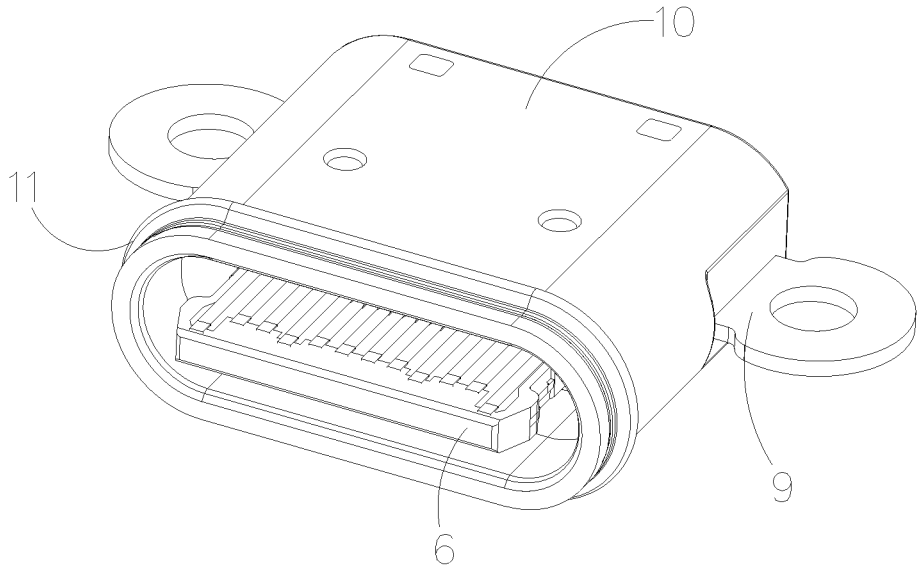
FIG. 1 is a perspective, assembled view of an electrical connector in accordance with an embodiment of the present application.
Figure 2:
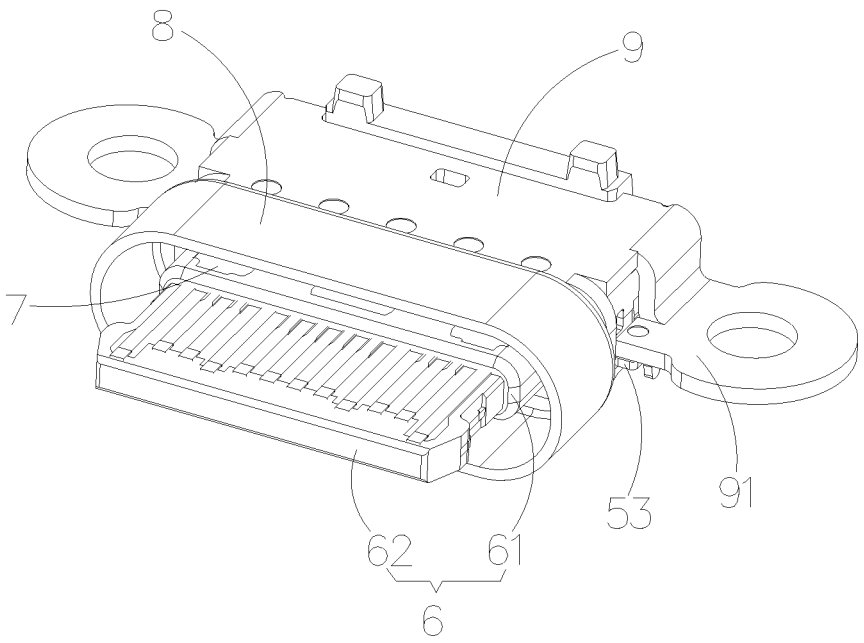
FIG. 2 is a partial perspective, assembled view of the electrical connector in accordance with the embodiment of the present application.
Figure 3:
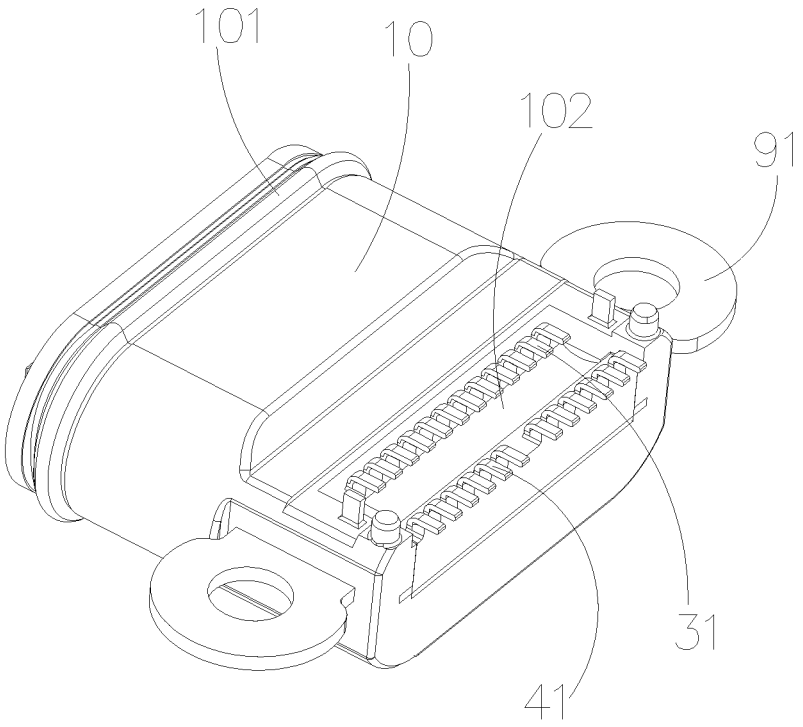
FIG. 3 is a view from another angle of FIG. 1.
Figure 4:
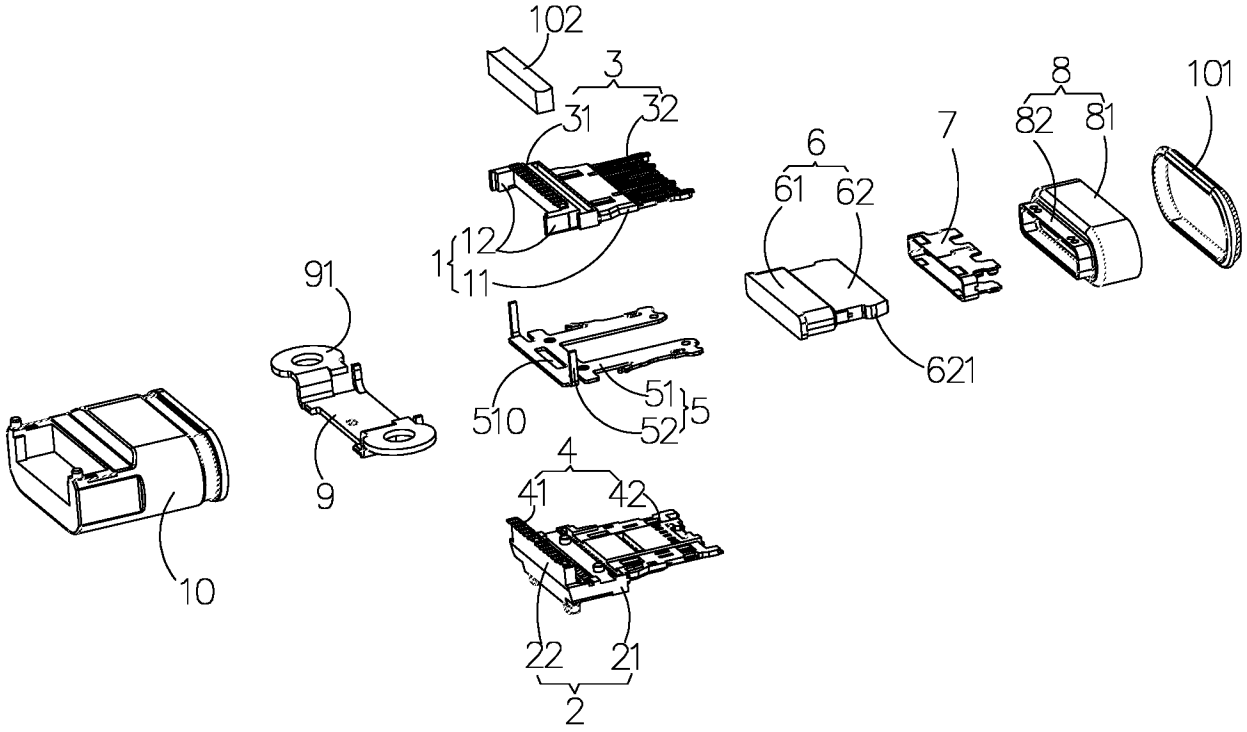
FIG. 4 is a perspective, exploded view of the electrical connector in accordance with the embodiment of the present application.
Figure 5:
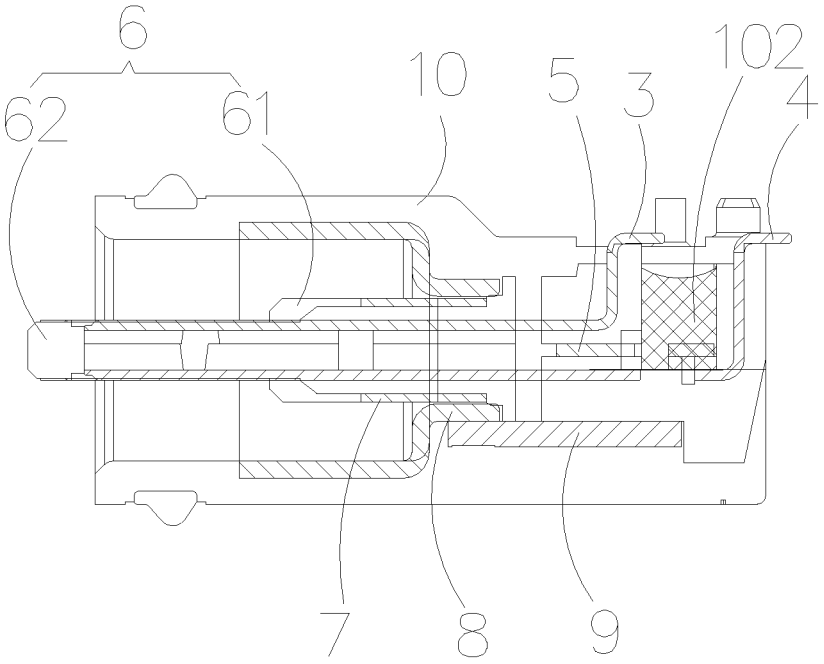
FIG. 5 is a cross-sectional view of the electrical connector in accordance with the embodiment of the present application along a mating direction.

Referring to FIGS. 1 to 5, an electrical connector in accordance with an illustrated embodiment of the present application includes a first lower insulating housing 1, a second upper insulating housing 2, conductive terminals (not labeled), a shielding plate 5, an insulating body 6, a metal shielding ring 7, an inner metal shell 8, an outer metal shell 9, and an insulative cover 10. The conductive terminals include a plurality of first conductive terminals 3 and a plurality of second conductive terminals 4.

The insulating body 6 is molded over the first lower insulating housing 1 and the second upper insulating housing 2. The insulating body 6 includes a base 61 and a tongue plate 62 extending forward from the base 61. A hook portion 621 is formed on each side of the tongue plate 62 for engaging with a mating connector. The first conductive terminals 3 are fixed to the first lower insulating housing 1. Each first conductive terminal 3 has a first contacting portion 32 exposed on a lower surface of the tongue plate 62 and a first tail portion 31 extending backward from the first contacting portion 32. The first tail portion 31 is located outside of the insulating body 6. The second conductive terminal 4 is fixed to the second upper insulating housing 2 and has a second contacting portion 42 exposed on an upper surface of the tongue plate 62 and a second tail portion 41 extending backward from the second contacting portion 42. The second tail portion 41 is located outside of the insulating body 6. The first tail portions 31 and the second tail portions 41 are arranged in two front-and-rear rows in a mating direction along which the electrical connector is engaged with the mating connector, i.e., the first tail portions 31 are arranged in a first and front row and the second tail portions 41 are arranged in a second and rear row spaced away from the first and front row of the first tail portions 31. The first tail portions 31 and the second tail portions 41 are adapted for connecting with a printed circuit board (not shown). In this embodiment of FIGS. 1 to 5, the first tail portions 31 and the second tail portions 41 are soldering portions which extend in a same horizontal plane. In other embodiments, the first tail portions 31 and the second tail portions 41 may also be plugging-in portions which extend in two parallel vertical planes.

The first lower insulating housing 1 includes a first main portion 11 and a pair of side portions 12 extending laterally and backwardly from the first main portion 11. The second upper insulating housing 2 includes a second main portion 21 and a rear stopper portion 22 extending backwardly and downwardly from the second main portion 21. The first main portion 11 is located below the second main portion 21, and the rear stopper portion 22 is located behind the first main portion 11. In assembling, the rear stopper portion 22 and the side portions 12 are exposed at a rear of the insulating body 6. A slot (not labeled) is surrounded by the first main portion 11, the rear stopper portion 22 and the pair of side portions 12. Specifically, the first tail portions 31 extend from a rear end portion of the first main portion 11 and located outside of the insulating body 6. Similarly, the second tail portions 41 extend from the rear stopper portion 22 and located outside of the insulating body 6.

The shielding plate 5 is sandwiched between the first lower insulating housing 1 and the second upper insulating housing 2. In an embodiment of the present application, the shielding plate 5 is embedded in the insulating body 6. The shielding plate 5 includes a base portion 51, a pair of leg portions 52 extending vertically from lateral sides of the base portion 51, and a pair of wing portions 53 located on the outer sides of the leg portions 52. The base portion 51 has a hole 510 corresponding to the slot. The leg portions 52 are located outside of the side portions 12, and are used for connecting with some ground pads on the printed circuit board to realize grounding purpose.

The metal shielding ring 7 is attached to the base 61, and the inner metal shell 8 is installed outside of the metal shielding ring 7. The front edge of the inner metal shell 8 is located behind the hook portion 621. The inner metal shell 8 has a larger-diameter circle portion 81 in the front thereof and a smaller-diameter circle portion 82 extending integrally and backwardly from the larger-diameter circle portion 81. The larger-diameter circle portion 81 surrounds around the insulating body 6. An insertion space is defined between the larger-diameter circle portion 81 and the insulating body 6 for receiving the mating connector. An outer surface of the metal shielding ring 7 contacts an inner surface of the smaller-diameter circle portion 82. The metal shielding ring 7 and the inner metal shell 8 are used together for realizing better electromagnetic shielding.

The outer metal shell 9 is mounted on an outer surface of the smaller-diameter circle portion 82, and therefore, the outer metal shell 9 is electrically connected to the inner metal shell 8. In other words, the outer metal shell 9 and the metal shielding ring 7 are located on opposite sides of the smaller-diameter circle portion 82.

The outer metal shell 9 has a pair of mounting portions 91 for locking with a casing of an external device (not shown). The mounting portions 91 are especially located on both lateral sides of the insulating body 6. Since positions of the mounting portions 91 are limited to both lateral sides of the insulating body 6, space in the mating direction is saved. The lower surface of the mounting portion 91 is electrically connected to the upper surface of the wing portions 53.

The insulative cover 10 is molded over the inner metal shell 8 and the outer metal shell 9. The insulative cover 10 has a plastic structure to achieve high-leveled waterproofing.

The electrical connector of the present application further includes a ring portion 101 assembled at the front end of the insulative cover 10. The ring portion 101 is used for sealing the electrical connector and the casing of the external device.

The electrical connector of the present application further includes a waterproof plate 102 which is formed by glue injection into the slot. The waterproof plate 102 is especially formed between the first tail portions 31 and the second tail portions 41. The slot is exposed on the side of the insulative cover 10 where the printed circuit board is installed, thereby facilitating the glue injection to form the waterproof plate 102. After injection, the waterproof plate 102 is located behind the insulating body 6. During injection, glue goes through the hole 510, thereby the waterproof plate 102 is located on both the upper and lower sides of the shielding plate 5.

Compared with the prior art, the slot which is used for glue injection to form the waterproof plate 102 is formed through an assembly process of the first lower insulating housing 1 and the second upper insulating housing 2. It is not necessary to insulate through a mold core during a second over-molding process of the insulative cover 10. The present application saves an operation step and improves the production efficiency. The waterproof plate 102 is formed by glue injection and is formed between the first tail portions 31 and the second tail portions 41. Furthermore, high-leveled waterproof effect is achieved, and the structure of the electrical connector is optimized. Additionally, because the outer metal shell 9 is electrically connected with the shielding plate 5, and the shielding plate 5 is electrically connected to the ground line of the printed circuit board, the inner metal shell 8 and the outer metal shell 9 are electrically connected to the printed circuit board via the leg portions 52 of the shielding plate 5 for grounding. The present application achieves a good grounding effect, thereby reducing the need for a ground area on the printed circuit board.

The above embodiments are only used to illustrate the present application and not to limit the technical solutions described in the present application. The understanding of this specification should be based on those skilled in the art. Descriptions of directions, such as "front", "back", "left", "right", "top" and "bottom", although they have been described in detail in the above-mentioned embodiments of the present application, those skilled in the art should understand that modifications or equivalent substitutions can still be made to the application, and all technical solutions and improvements that do not depart from the spirit and scope of the application should be covered by the claims of the application.

What is claimed is:

1. An electrical connector (100) comprising:

a first lower insulating housing (1);

a second upper insulating housing (2);

a plurality of first conductive terminals (3) held on the first lower insulating housing (1), each first conductive terminal (3) comprising a first tail portion (31) for connecting with a printed circuit board, the first tail portions (31) being arranged in a first and front row;

a plurality of second conductive terminals (4) held on the second upper insulating housing (2), each second conductive terminal (4) comprising a second tail portion (41) for connecting with the printed circuit board, the second tail portions (41) being arranged in a second and rear row spaced away from the first and front row of the first tail portions (31);

an insulating body (6) molded over the first lower insulating housing (1) and the second upper insulating housing (2), the insulating body (6) comprising a base (61) and a tongue plate (62) extending forwardly from the base (61);

a metal shielding ring (7) attached to the base (61);

an inner metal shell (8) installed outside of the metal shielding ring (7), the inner metal shell (8) comprising a larger-diameter circle portion (81) and a smaller-diameter circle portion (82) extending integrally and backwardly from the larger-diameter circle portion (81), the large-diameter circle portion (81) surrounding the insulating body (6) to form an insertion space, the metal shielding ring (7) connected to an inner surface of the smaller-diameter circle portion (82); and a waterproof plate (102) formed between the first tail portions (31) and the second tail portions (41) by glue injection.

2. The electrical connector (100) according to claim 1, wherein the first lower insulating housing (1) comprises a first main portion (11) and a pair of side portions (12) extending laterally and backwardly from the first main portion (11), the second upper insulating housing (2) comprises a second main portion (21) and a rear stopper portion (22) extending backwardly and downwardly from the second main portion (21), the first main portion (11) is located below the second main portion (21) and the rear stopper portion (22) is located behind the first main portion (11), and wherein a slot is surrounded by the first main portion (11), the rear stopper portion (22) and the side portions (12), and wherein the waterproof plate (102) is formed by the glue injection into the slot.

3. The electrical connector (100) according to claim 2, further comprising a shielding plate (5) sandwiched between the first lower insulating housing (1) and the second upper insulating housing (2); wherein the shielding plate (5) comprises a base portion (51) and a pair of leg portions (52) extending vertically from lateral sides of the base portion (51), the base portion (51) comprises a hole (510) corresponding to the slot, and glue goes through the hole (510) during injecting so that the waterproof plate (102) is located on both upper and lower sides of the shielding plate (5).

4. The electrical connector (100) according to claim 2, wherein each first conductive terminal (3) comprises a first contacting portion (32) exposed on a lower surface of the tongue plate (62) and each second conductive terminal (4) comprises a second contacting portion (42) exposed on an upper surface of the tongue plate (62); and wherein the rear stopper portion (22), the side portions (12) and the waterproof plate (102) are all located behind and exposed outside of the insulating body (6).

5. The electrical connector (100) according to claim 1, further comprising an outer metal shell (9) mounted on an outer surface of the smaller-diameter circle portion (82); wherein the outer metal shell (9) comprises a pair of mounting portions (91) for locking with a casing of an external device, and the mounting portions (91) are located on lateral sides of the insulating body (6).

6. The electrical connector (100) according to claim 5, further comprising an insulative cover (10) which is molded over the inner metal shell (8) and the outer metal shell (9).

7. The electrical connector (100) according to claim 6, further comprising a ring portion (101) assembled at a front end of the insulative cover (10) to seal the electrical connector and the casing of the external device.

8. An electrical connector (100) comprising:

an insulating body (6);

a plurality of terminals retained in the insulating body (6);

a shielding plate (5) embedded in the insulating body (6), the shielding plate (5) comprising a base portion (51) and at least one leg portion (52) extending vertically from at least one lateral side of the base portion (51) for electrically connecting with at least one grounding pad of a printed circuit board;

an inner metal shell (8) enclosing the insulating body (6), the inner metal shell (8) comprising a larger-diameter circle portion (81) and a smaller-diameter circle portion (82) extending integrally and backwardly from the larger-diameter circle portion (81), the larger-diameter circle portion (81) surrounding the insulating body (6) to form an insertion space therebetween for receiving a mating connector; and an outer metal shell (9) assembled to the inner metal shell (8) with a lower surface of the outer metal shell (9) contacting an outer surface of the smaller-diameter circle portion (82), so as to establish grounding connection with the inner metal shell (8) and the shielding plate (5).

9. The electrical connector (100) according to claim 8, wherein the outer metal shell (9) comprises a pair of mounting portions (91) for locking with a casing of an external device, and the shielding plate (5) comprises a pair of the leg portions (52) and a pair of wing portions (53) located outside of the leg portions (52); and wherein the mounting portions (91) are connected to the wing portions (53).

10. The electrical connector (100) according to claim 8, further comprising a metal shielding ring (7) attached to the insulating body (6); wherein an outer surface of the metal shielding ring (7) contacts an inner surface of the smaller-diameter circle portion (82).

11. The electrical connector (100) according to claim 8, further comprising an insulative cover (10) molded over the inner metal shell (8) and the outer metal shell (9), and a ring portion (101) assembled at a front end of the insulative cover (10) to seal the electrical connector and a casing of an external device.

12. The electrical connector (100) according to claim 8, wherein the insulating body (6) comprises a base (61) and a tongue plate (62) extending forwardly from the base (61); and wherein a hook portion (621) is formed on each side of the tongue plate (62) for engaging with the mating connector.

13. The electrical connector (100) according to claim 12, wherein the terminals comprise a plurality of first conductive terminals (3) and a plurality of second conductive terminals (4), each first conductive terminal (3) comprising a first contacting portion (32) exposed on a lower surface of the tongue plate (62) and a first tail portion (31) extending backwardly beyond the base (61) for connecting with a printed circuit board, each second conductive terminal (4) comprising a second contacting portion (42) exposed on an upper surface of the tongue plate (62) and a second tail portion (41) extending backwardly beyond the base (61) for connecting with the printed circuit board; and wherein the first tail portions (31) and the second tail portions (41) are arranged in a front row and a rear row, respectively, the front row and the rear row are spaced away from each other along a mating direction for soldering on the printed circuit board.

14. The electrical connector (100) according to claim 13, further comprising a first insulating housing (1) to retain the first conductive terminals (3) and a second insulating housing (2) to retain the second conductive terminals (4); and wherein the second insulating housing (2) is assembled on an upper side of the first insulating housing (1).

15. The electrical connector (100) according to claim 14, further comprising a waterproof plate (102) which is formed between the first tail portions (31) and the second tail portions (41) by glue injection into a slot, and the slot is formed by stacking the first insulating housing (1) and the second insulating housing (2).

16. The electrical connector (100) according to claim 15, wherein the first lower insulating housing (1) comprises a first main portion (11) and a pair of side portions (12) extending laterally and backwardly from the first main portion (11), the second upper insulating housing (2) comprises a second main portion (21) and a rear stopper portion (22) extending backwardly and downwardly from the second main portion (21), the first main portion (11) is located below the second main portion (21), and the rear stopper portion (22) is located behind the first main portion (11); and wherein the slot is surrounded by the first main portion (11), the rear stopper portion (22) and the side portions (12).

17. An electrical connector (100) comprising:

a first lower insulating housing (1);

a second upper insulating housing (2);

a plurality of first conductive terminals (3) retained in the first lower insulating housing (1);

a plurality of second conductive terminals (4) retained in the second upper insulating housing (2);

an insulating body (6) molded over the first lower insulating housing (1) and the second upper insulating housing (2);

a shielding plate (5) sandwiched between the first lower insulating housing (1) and the second upper insulating housing (2) and embedded in the insulating body (6), the shielding plate (5) comprising a base portion (51) and at least one leg portion (52) extending vertically from at least one lateral side of the base portion (51) for electrically connecting with at least one grounding pad of a printed circuit board;

an inner metal shell (8) enclosing the insulating body (6), the inner metal shell (8) comprising a larger-diameter circle portion (81) and a smaller-diameter circle portion (82) extending integrally and backwardly from the larger-diameter circle portion (81), the larger-diameter circle portion (81) surrounding the insulating body (6) to form an insertion space therebetween for receiving a mating connector;

an outer metal shell (9) assembled to the inner metal shell (8) with a lower surface of the outer metal shell (9) contacting an outer surface of the smaller-diameter circle portion (82), so as to establish grounding connection with the inner metal shell (8) and the shielding plate (5); and a waterproof plate (102) formed by glue injection into a slot which is formed by stacking the first insulating housing (1) and the second insulating housing (2).

18. The electrical connector (100) according to claim 17, wherein the first lower insulating housing (1) comprises a first main portion (11) and a pair of side portions (12) extending laterally and backwardly from the first main portion (11), the second upper insulating housing (2) comprises a second main portion (21) and a rear stopper portion (22) extending backwardly and downwardly from the second main portion (21), the first main portion (11) is located below the second main portion (21), and the rear stopper portion (22) is located behind the first main portion (11); and wherein the slot is surrounded by the first main portion (11), the rear stopper portion (22) and the side portions (12).

* * * * *